United States Patent [19]

Martwick

[11] Patent Number: 4,938,145

[45] Date of Patent: Jul. 3, 1990

[54] CASED TELESCOPED AMMUNITION HAVING FEATURES AUGMENTING CARTRIDGE CASE DIMENSIONAL RECOVERY BY CASE SKIN TUBE

[75] Inventor: Wilford E. Martwick, Minneapolis, Minn.

[73] Assignee: Honeywell Inc., Minneapolis, Minn.

[21] Appl. No.: 440,489

[22] Filed: Nov. 24, 1989

Related U.S. Application Data

[63] Continuation of Ser. No. 154,560, Feb. 10, 1988, abandoned.

[51] Int. Cl.[5] ..... F42B 5/045

[52] U.S. Cl. ..... 102/434; 102/430; 102/464; 102/469

[58] Field of Search ..... 102/430, 433, 434, 464–472

[56] References Cited

U.S. PATENT DOCUMENTS

| | | | |
|---|---|---|---|
| 190,208 | 5/1877 | Gill | 102/464 |
| 300,449 | 6/1884 | Dickey . | |
| 331,511 | 12/1885 | Lorenz . | |
| 546,936 | 9/1895 | Pinfold . | |
| 702,208 | 6/1902 | Hayner . | |
| 1,062,604 | 5/1913 | Pedersen . | |
| 1,079,083 | 11/1913 | Wesson . | |
| 1,094,565 | 4/1914 | Hoagland . | |
| 1,103,203 | 7/1914 | Hoagland | 102/464 |
| 1,470,591 | 10/1923 | Behar | 102/430 |
| 1,974,270 | 9/1934 | Guignet | 102/12 |
| 2,349,970 | 5/1944 | Lambeek | 102/43 |
| 2,402,068 | 6/1946 | Meador | 148/12 |
| 2,535,624 | 12/1950 | Burney | 102/38 |
| 2,568,080 | 9/1951 | McGahey, Jr. | 102/38 |
| 2,853,945 | 9/1958 | Stealey | 102/44 |
| 2,866,412 | 12/1958 | Meyer et al. | 102/38 |
| 2,920,565 | 1/1960 | Heidmann | 102/43 |
| 2,938,458 | 5/1960 | O'Brien | 102/38 |
| 2,996,988 | 8/1961 | Kunz | 102/38 |
| 3,009,394 | 11/1961 | Kamp et al. | 102/430 |
| 3,279,373 | 10/1966 | Stadler et al. | 102/44 |
| 3,568,599 | 3/1971 | Dardick | 102/38 |
| 3,590,740 | 7/1971 | Herter | 102/44 |
| 3,761,322 | 9/1973 | Winter et al. | 148/11.5 A |
| 3,948,178 | 4/1976 | Luther et al. | 102/43 R |
| 4,000,697 | 1/1977 | Levine | 102/38 |
| 4,197,801 | 4/1980 | La Fever et al. | 102/38 CC |
| 4,202,270 | 5/1980 | Luther et al. | 102/43 R |
| 4,220,089 | 9/1980 | Smith | 102/38 R |
| 4,233,903 | 11/1980 | Lage | 102/466 |
| 4,335,657 | 6/1982 | Bains | 102/433 |
| 4,604,954 | 8/1986 | Clarke et al. | 102/434 |

FOREIGN PATENT DOCUMENTS

| | | | |
|---|---|---|---|
| 509830 | 9/1953 | Belgium | 102/464 |
| 13425 | of 1885 | United Kingdom | 102/464 |
| 400801 | 11/1933 | United Kingdom . | |

*Primary Examiner*—Harold J. Tudor
*Attorney, Agent, or Firm*—Roger W. Jensen

[57] ABSTRACT

A cased telescoped ammunition round includes a propellant charge disposed in a tubular case. The case is composed of a skin tube and end caps on opposite ends of the tube. The case defines a chamber that contains the propellant charge. The charge has an axial bore containing a control tube at least at an aft portion of the bore. The control tube is attached at least at its aft end to the aft one of the case end caps. A projectile is housed within a forward portion of the axial bore of the propellant charge, and a primer is disposed within an aft portion of the control tube. The primer is actuatable for igniting the propellant charge to cause firing of the projectile forwardly from the case. Features are provides for locking the end caps onto the opposite ends of the skin tube of the round case and for permitting elongation of the skin tube in response to increased internal pressure while causing contraction of the tube upon relief of the pressure to ensure partial dimensional recovery of the tubular case after firing of the projectile so that the case can be ejected from the gun chamber.

13 Claims, 5 Drawing Sheets

CASED TELESCOPED AMMUNITION HAVING FEATURES AUGMENTING CARTRIDGE CASE DIMENSIONAL RECOVERY BY CASE SKIN TUBE

CROSS REFERENCE TO RELATED APPLICATIONS

Reference is hereby made to the following copending U.S. patent applications dealing with related subject matter and assigned to the same assignee of the present invention.

1. "Cased Telescoped Ammunition Having Features Augmenting Cartridge Case Dimensional Recovery By Center Sleeve" by W. Martwick et al, assigned U.S. Ser. No. 154,416 and filed Feb. 10, 1988, now U.S. Pat. No. 4,907,510.

2. "Cased Telescoped Ammunition Having Features Augmenting Cartridge Case End Cap Retention and Retraction" by B. Tasson et al, assigned U.S. Ser. No. 154,564 and filed Feb. 10, 1988, now U.S. Pat. No. 4,846,069, issued July 11, 1989.

This application is a continuation of application Ser. No. 07/154,560, filed Feb. 10, 1988, now abandoned.

BACKGROUND OF THE INVENTION

1. Field of the Invention

The present invention generally relates to cased telescoped ammunition and, more particularly, is concerned with features augmenting cartridge case dimensional recovery brought about by a case skin tube of the ammunition round.

2. Description of the Prior Art

Cased telescoped ammunition is generally well-known. Representative prior art versions of such ammunition are disclosed in U.S. Pat. Nos. to Meyer et al (2,866,412), Kunz (2,996,988), LaFever et al (4,197,801), Smith (4,220,089), Bains (4,335,657) and Clarke et al (4,604,954).

Typically, a round of cased telescoped ammunition includes an elongated cylindrical case defining a chamber that contains a propellant charge. The propellant charge has an axial bore through which extends a center sleeve in coaxial relation with the case and fastened at its opposite ends to the opposite ends of the case. A telescoped projectile is housed within a forward portion of the center sleeve, whereas an aft portion of the center sleeve, referred to as a control tube, receives a piston or spud on the aft end of the projectile. A primer is positioned within the control tube aft of the projectile spud, and a small amount of propellant is contained therein between the primer and the spud.

The round of ammunition is loaded in a gun chamber located rearwardly of the gun barrel. When the round is fired, the primer ignites the small amount of propellant in the control tube. The resulting gas applies a force against the spud, driving the projectile forwardly out of the center sleeve and into the gun barrel. Next, the hot gas ignites the main propellant charge surrounding the projectile. Burning of the propellant charge produces gas at much higher pressure which drives the projectile through the gun barrel to exit the muzzle at high velocity.

The increasing pressure created by the burning propellant charge expands the ammunition case axially and radially. Expansion of the case is constrained by the opposite ends and cylindrical interior surface of the gun chamber housing the ammunition round. The pressure also acts to elastically deform the gun, enlarging the chamber. Then, when the pressure is relieved by exit of the projectile from the gun barrel, the gun chamber reverts to its unpressurized dimensions. In order to extract the case from the gun chamber, it is necessary that the case return or recover at least to dimensions which allow clearance between it and the ends and interior surface of the chamber.

Because elastic deformations of typical guns using cased telescoped ammunition are so large, special steps are required to attain the cartridge case springback required. In a typical round currently available, one step taken is to split longitudinally the skin tube of the cartridge case to relieve any pressure between the yielded skin tube and the recovered chamber diameter. The end caps are free to move relative to the split skin tube and require special measures to maintain some connection between the end caps and split skin tube. The special measures required to connect the end caps and tube skin make for unreliable cartridge case integrity, particularly after firing. Also, splitting of the skin tube allows undesirable blackening of the gun chamber to occur during firing of the round.

Therefore, a need still exists for a different approach to achievement of dimensional recovery of a cased telescoped ammunition round.

SUMMARY OF THE INVENTION

The present invention provides cased telescoped ammunition designed to satisfy the aforementioned needs. The present invention encompasses several different features associated with the case skin tube of a round of cased telescope ammunition for augmenting cartridge case dimensional recovery by the skin tube. Some of these features are advantageously incorporated together to realize significantly improved cartridge case dimensional recovery; however, improvement of dimensional recovery can be obtained by employment of certain of the features separately from or as alternatives to certain of the others.

The cased telescoped ammunition round in which the features of the present invention are employed comprises the combination of: (a) an elongated propellant charge having an axial bore therethrough; (b) an elongated tubular case composed of a skin tube and end caps on opposite ends of the tube, the case defining a chamber that contains the propellant charge; (c) tubular means disposed in the case extending at least partially through the axial bore of the propellant charge at an aft portion thereof and attached at least at its aft end to the aft end of the case; (d) a projectile housed within a forward portion of the axial bore of the propellant charge; and (e) a primer positioned within an aft portion of the tubular means and being actuatable for igniting the propellant charge for causing firing of the projectile forwardly from the case. The features of the present invention generally relate to different types of resiliently-yieldable spring means associated with the tubular case for yieldably resisting stretching and augmenting contraction thereof for recovery of the cartridge case back to dimensions allowing its ejection from a gun chamber.

One feature relates to the provision of such spring means in the form of an annular groove or bead defined about the circumference of the skin tube of the case and projecting into the chamber defined by the case. The bead is arcuate or semi-circular shaped in cross section. In the annular depression defined on its exterior side, the bead is filled by a resiliently flexible and compressible material. The bead and compressible material therein are adapted to allow the case to elongate or stretch longitudinally in response to high internal pressure created by ignition of the propellant charge and then to contract back toward (but stop short of) its original dimensions in response to relief of the pressure.

Another feature is directed to means for locking the end caps onto the opposite ends of the skin tube of the round case. The feature relates to the use of a plurality of spring fingers, being of substantially equal length, pierced out from the case skin tube adjacent each of the opposite ends thereof and applied to an annular groove or recess defined in each of the end caps. The spring fingers at one tube end are bent to project in an inclined fashion either inside or outside of the tube and toward the opposite tube end. The bottom of the recess slants at a slight angle to the skin tube so as to complement the particular inclination of the spring fingers.

In one embodiment, the annular recess is defined on the exterior of an annular flange of each end cap. The spring fingers deflect within the skin tube. Each respective skin tube end is fitted over the exterior of the end cap flange and the spring fingers are seated in locking relation in the slanted recess.

In another embodiment, the annular recess is defined on the interior of each respective end cap flange. The spring fingers deflect outside of the skin tube. Each respective skin tube end is fitted within the interior of the end cap flange and the spring fingers are seated in locking relation in the slanted recess. Preferably, the spring fingers at each opposite skin tube end are used in combination with the compressible material-filled annular bead to ensure dimensional recovery of the case, the spring fingers functioning to lock the end caps to the skin tube.

Still another feature provides both means for locking the end caps onto the opposite ends of the skin tube of the round case and for permitting elongation of the skin tube in response to increased internal pressure while causing retraction of the tube upon relief of the pressure. The feature relates to the use of a pair of groups of spring fingers, the fingers in one group being of greater length than those in the other group. The fingers in both groups are pierced out from the case skin tube adjacent each of the opposite ends thereof and applied to an annular recess defined in the exterior of an annular flange of each end cap. The spring fingers at one tube end are bent to project in inclined fashion inside of the tube and toward the opposite tube end. The bottom of the recess slants at a slight angle to the skin tube so as to complement the inclination of the spring fingers.

Each of the spring fingers includes a free end unattached to the skin tube and a base where it is attached to the skin tube. Each finger is located in the center of a beam portion defined circumferentially at the respective tube ends by short slits made through the skin tube ends which start from opposite sides of the finger at the base thereof and terminate short distances therefrom. The respective slits associated with the longer fingers are longer than the slits associated with the shorter fingers such that the beam portions connected to the longer fingers are longer than the beam portions connected to the shorter fingers. The longer fingers alternate with the shorter ones. The longer beam portions are aligned with one another circumferentially about the tube end and located contiguous with the tube edge portion at each respective tube end. The shorter beam portions are aligned with one another circumferentially about the tube end and located inwardly from and generally in tandem relation with the longer beam portions. In other words, the longer beam portions are located outboard of the shorter beam portions at the respective tube ends.

The longer fingers connected with the longer outboard beam portions are designed to rest in the recess with their free ends in contact with an inboard end of the recess, whereas the free ends of the shorter fingers are spaced therefrom. Upon elongation of the skin tube, the longer outboard beam portions will deflect first and then the shorter inboard beam portions will deflect once the free ends of the shorter fingers contact the recess inboard end.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Cased Telescoped Ammunition

Figure 1:
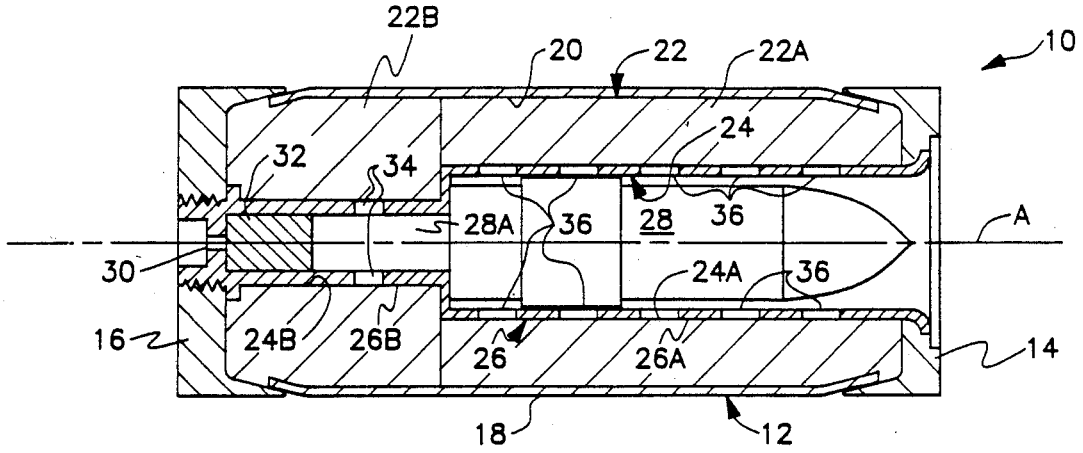
Fig. 1 (PRIOR ART)
FIG. 1 is a longitudinal axial sectional view of a prior art cased telescoped ammunition round.
Figure 2:
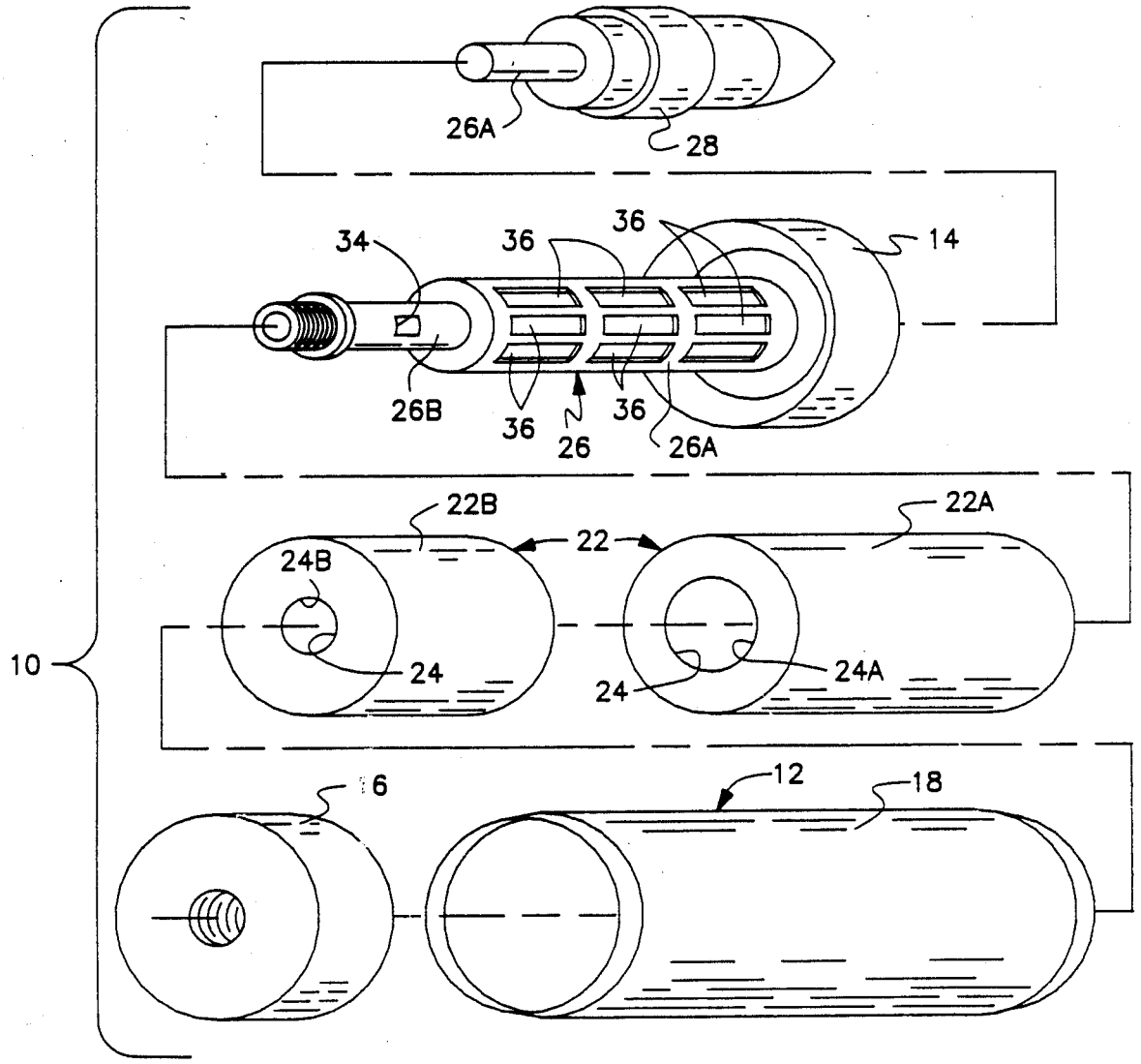
Fig. 2 (PRIOR ART)
FIG. 2 is an exploded perspective view of the prior art round of FIG. 1.

Referring now to FIGS. 1 and 2 of the drawings, there is shown a prior art round of cased telescoped ammunition, generally designated by the numeral 10. The ammunition round 10 includes an elongated cylindrical case 12 composed of a pair of forward and aft end seals or caps 14, 16 sealed on opposite ends of a skin tube 18. The case 12 defines a chamber 20 that contains a propellant charge 22 composed of forward and aft portions 22A, 22B. The propellant charge 22 has an axial bore 24 (composed of corresponding forward and aft portions 24A, 24B) through which extends a center sleeve in coaxial relation with the case 12. The center sleeve 26 is fastened at its opposite ends to the end caps 14, 16.

A tapered or telescoped projectile 28 is housed within a forward end portion 26A of the center sleeve 26. An aft end portion of the center sleeve 26, referred to as a control tube 26B, has a substantially smaller diameter size and is shorter in length than the forward end portion 26A thereof. The projectile 28 incorporates a short piston or spud 28A of reduced diameter on its aft end which extends in a close fitting relation into the control tube 26B of the center sleeve 26. A primer 30 is also positioned within the control tube 26B aft of the projectile spud 28A and a small amount of propellant 32 is contained in the control sleeve 26B between the primer 30 and the projectile spud 28A. Windows or vents 34, 36 are respectively formed through the aft end portion or control tube 26B and the forward end portion 26A of the center sleeve 26.

In operation, the primer 30 is fired initiating the small amount of propellant 32 in the control tube 26B aft of the projectile spud 28A. Expansion of the resulting gas generated by the initiated propellant 32 applies an increasing force against the spud 28A, driving the projectile 28 forward out of the center sleeve 28 and into the rear end of a gun barrel. As the end of the projectile spud 28A moves forward in the control tube 26B of the center sleeve 26, it exposes the vents 34 therein and thereafter the vents 36 in the forward end portion of the center sleeve 26. The hot gas generated by the initiated propellant 32 then ignites the main propellant charge 22 surrounding the projectile 28. Burning of the propellant charge 22 produces gas at much higher pressure which drives the projectile through the gun barrel to exit the muzzle at high velocity.

The increasing pressure created by the burning propellant charge 22 elongates the case skin tube 18 and forces the end caps 14, 16 apart to the point where they are constrained by the opposite ends of a gun chamber (not shown) which houses the ammunition round 10. The pressure also forces the case skin tube 18 radially outward into intimate contact with the cylindrical interior surface of the gun chamber. After intimate contact has been achieved, the pressure continues to increase and act to elastically deform the gun, enlarging the chamber and forcing apart the ends thereof.

When the pressure is relieved by the exit of the projectile from the muzzle of the barrel, the gun chamber reverts to its unpressurized dimensions. In order to extract the case 12 from the cylindrical gun chamber, it is necessary that the case 12 return or recover at least to dimensions which allow clearance between the end caps 14, 16 of the case 12 and the opposite breech and barrel faces or ends of the chamber as well as radially between the case 12 and interior cylindrical surface of the chamber. It is essential that features be incorporated in the ammunition which will ensure that such dimensional recovery takes place. These features of the present invention will now be described in detail. The same reference numerals will be used to designate parts generally similar to those above.

Features of the Present Invention

Figure 3:
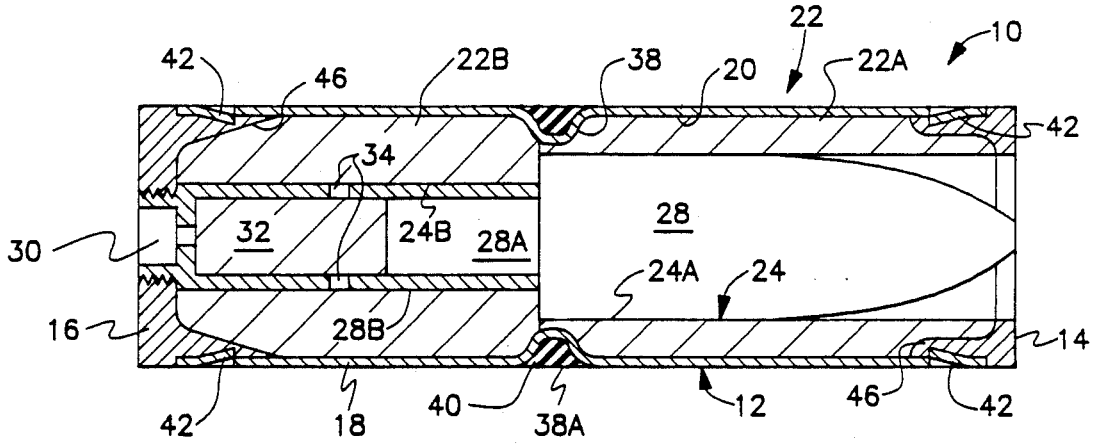
FIG. 3 is a longitudinal axial sectional view of a cased telescoped ammunition round incorporating several of the features of the present invention for achieving dimensional recovery of the ammunition case.

Turning now to FIG. 3, these is shown several features of the present invention provided on the case skin tube 18 of the round to make dimensional recovery of the cartridge case possible. The features provide attachment means for locking the end caps 14, 16 onto the opposite ends of the skin tube 18 of the round case 12 and spring means for permitting stretching or elongation of the skin tube 18 in response to increased internal pressure while causing contraction of the tube 18 upon relief of the pressure.

One feature relates to the provision of such spring means in the form of a filled annular groove or bead 38 defined in the case skin tube 18 that is designed to act as a spring, resiliently stretching in response to high internal pressures created by burning of the propellant charge 22 for firing of the projectile 28 and then returning or contracting nearly to its original dimensions in response to relief of the pressure. The filled annular bead 38 thus controls residual length change of the skin tube 18 in a manner compatible with change in the length of the gun chamber. The skin tube 18 and end caps 14, 16 are preferably composed of high yield strength material which controls the radial residual growth of the tube. Radial growth and clearance after firing is accommodated by the high yield strength of the tube 18 and end cap material. Clearance after firing is assured by having the yield strength divided by the modulus of the material greater than the elastic growth of the gun chamber under pressure (in inches/inch).

More particularly, the the annular bead 38 is defined about the circumference of the skin tube 18 of the case 12 at a location about midway between its opposite ends. The bead 38 projects into the chamber 20 defined by the case 12, and is arcuate or semi-circular shaped in cross section. The adjacent end portions of the forward and aft portions 22A, 22B of the propellant charge 22 are correspondingly shaped to accommodate the projection of the bead 38 into the case chamber 20.

In an annular depression 38A defined on its (and the case's) exterior side, the bead 38 is filled by a suitable resiliently flexible and compressible material 40, such as RTV (room temperature vulcanized) silicone rubber. As depicted in FIGS. 5A–5C and 6A–6C, the bead 38 and compressible material 40 therein can be elongated and contracted in the axial direction of the case 12 to allow the case to elongate or stretch longitudinally in response to high internal pressure created by ignition of the propellant charge 22 and then to contract back toward (but stop short of) its original dimensions in response to relief of the pressure (see parallel lines and arrows in FIGS. 5B and 5C and 6B and 6C). Were the bead 38 not filled with the material 40 to occupy some of the volume of the depression 38A, the internal pressure would merely deform the bead 38 to conform to the gun chamber at its full expansion and increase the length of the round case 12 to an unacceptable value.

Figure 4:
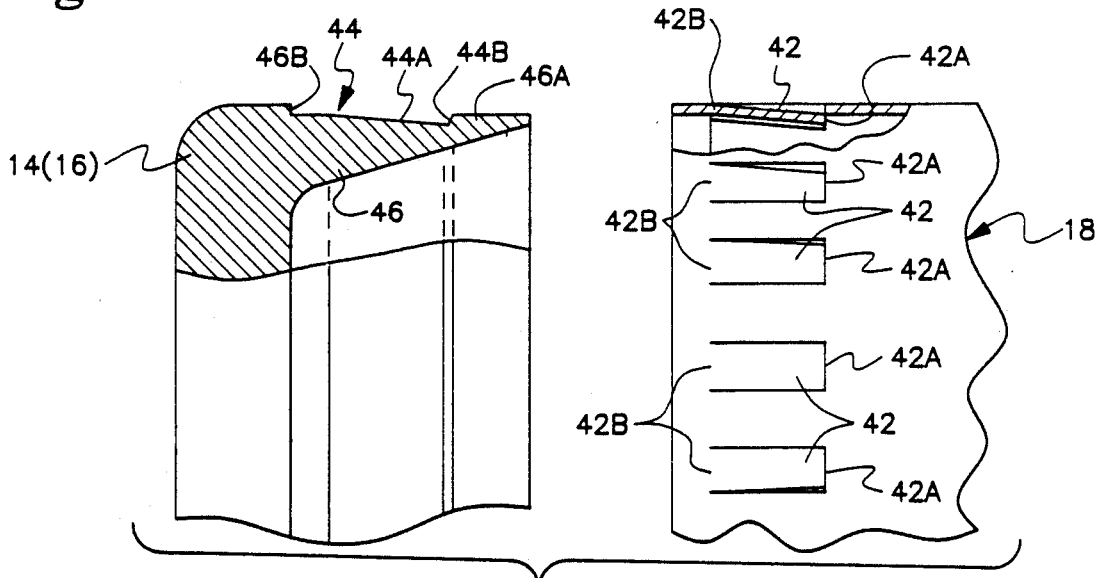
FIG. 4 is an exploded fragmentary view, partly in section, of the ammunition round of FIG. 3, showing one embodiment of certain features of the present invention associated with the skin tube and end caps of the round case for locking the end caps and tube together.
Figure 7:
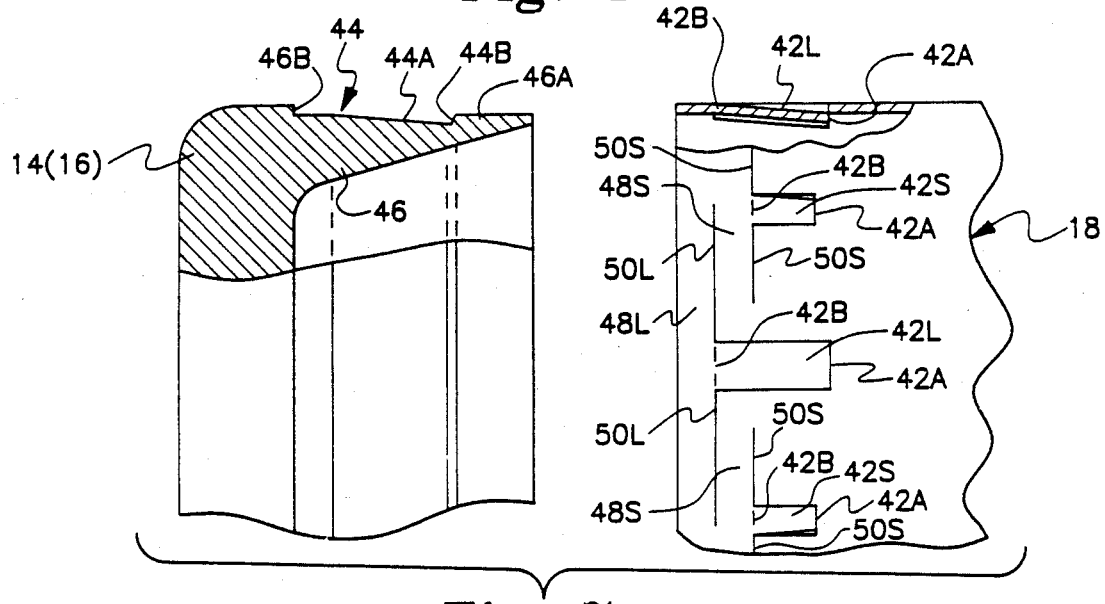
FIG. 7 is an exploded fragmentary view, partly in section, of an ammunition round similar to that of FIG. 4, showing another feature of the present invention associated with the skin tube and end caps of the round case for locking the end caps and tube together and for providing yieldable elongation and recovery of the skin tube.
Figure 5A:
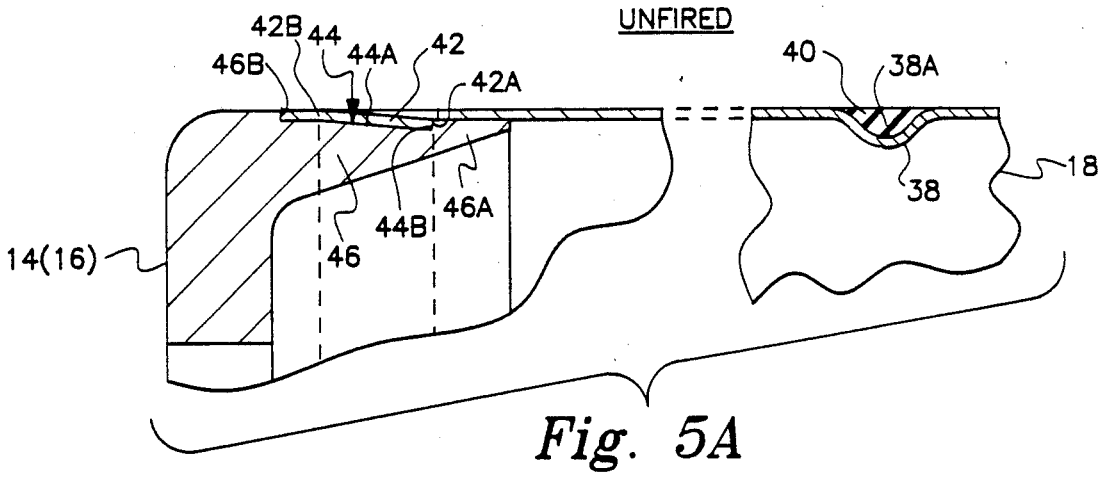
FIGS. 5A–5C are sequential fragmentary views of the ammunition round of FIG. 3, showing the features of the present invention illustrated in FIG. 3 in conditions where the ammunition is unfired, is under full pressure after firing, and is relieved of pressure after firing.
Figure 5B:
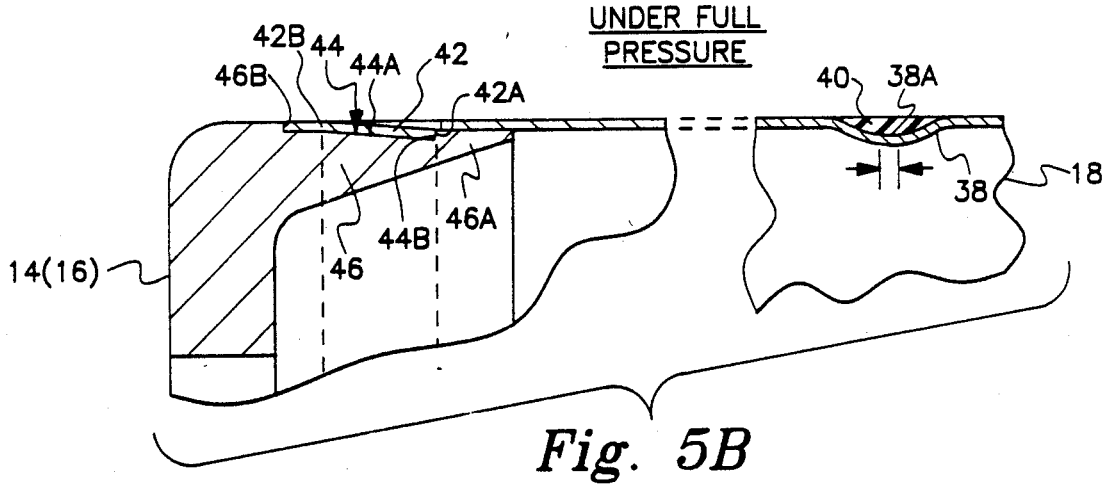
Figure 5C:
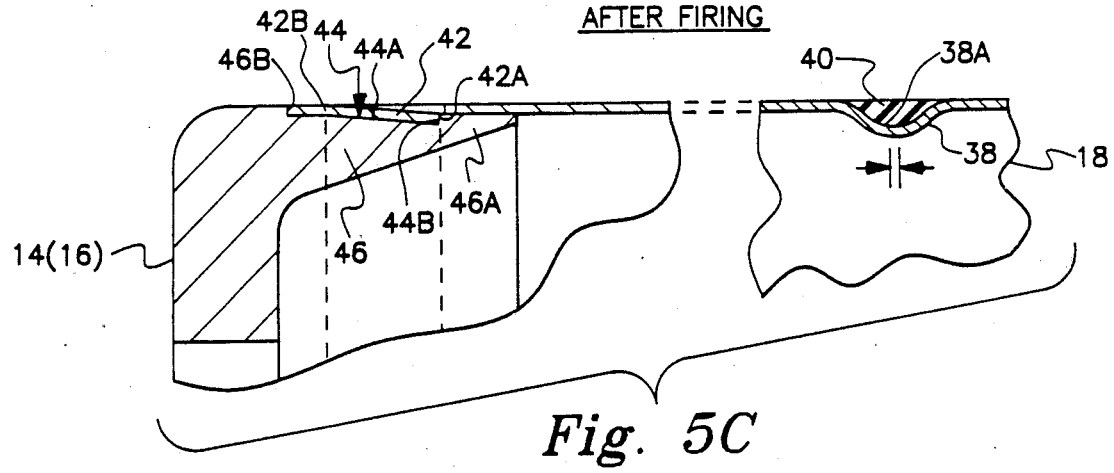

Referring to FIG. 4, there is shown the other feature providing attachment means for locking the end caps 14, 16 onto the opposite ends of the skin tube 18 of the round case 12. The feature relates to the provision of a plurality of spring fingers 42, being of substantially equal length, pierced out from the case skin tube 18 adjacent each of the opposite ends thereof. Each spring finger 42 extends in the axial direction of the case 12 and includes a free end 42A unattached to the skin tube 18 and a base 42B where it is attached to the skin tube 18. The fingers 42 are applied to an annular groove or recess 44 defined in each of the end caps 14, 16. The spring fingers 42 at each one of the tube ends are bent to project in an inclined fashion either inside or outside of the tube and toward the opposite tube end. The bottom 44A of the recess 44 slants at a slight angle to the skin tube 18 so as to complement the particular inclination of the spring fingers 42.

In one embodiment shown in FIGS. 4 and 5A–5C, the annular recess 44 is defined on the exterior of an cylindrical or annular flange 46 of each end cap 14,16. The spring fingers 42 deflect within the skin tube 18. Each respective end of the skin tube 18 is fitted over the exterior of the end cap flange 46 and the spring fingers 42 are seated in locking relation in the slanted recess 44 with their free ends 42A abutting an inboard end 44B of the recess 44. More particularly, each end cap 14, 16 is in the form of a cup having the annular flange 46 which tapers to a thin lip at its open end. The outside of the flange 46 has a reduced diameter section 46A adapting the flange to slide inside of the end of the tube 18. This reduced diameter section 46A ends in an annular outboard shoulder 46B against which the end edge of the tube 18 abuts when assembled to the respective end cap 14, 16. The recess 44 is machined in this reduced diameter section 46A and tapers or slants from zero depth toward the closed end of the end cap to a depth of slightly more than the skin tube thickness toward the open end of the end cap.

Figure 6A:
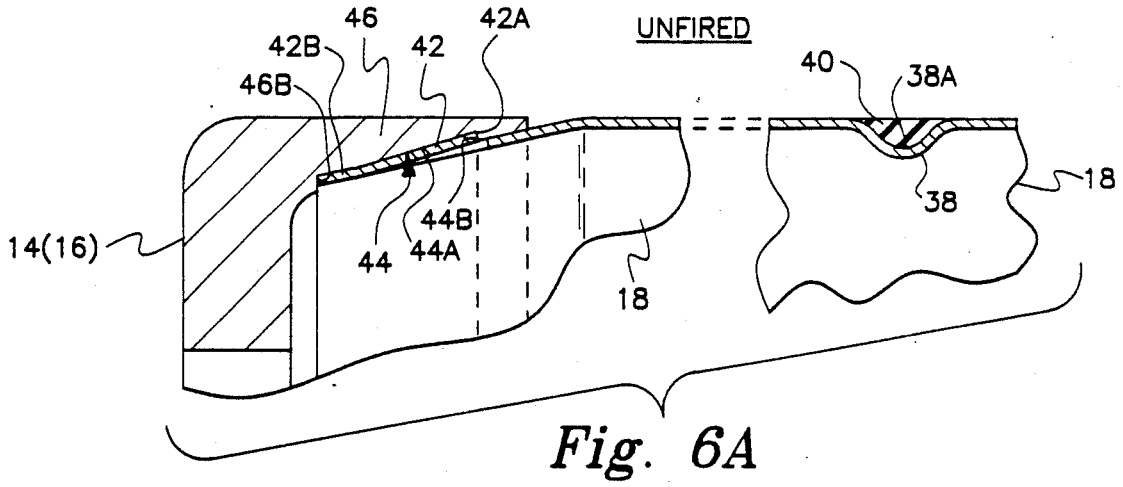
FIGS. 6A–6C are sequential fragmentary views of an ammunition round similar to those of FIGS. 5A–5C, except another embodiment of certain features of the present invention associated with the skin tube and end caps of the round case for locking the end caps and tube together is illustrated.
Figure 6B:
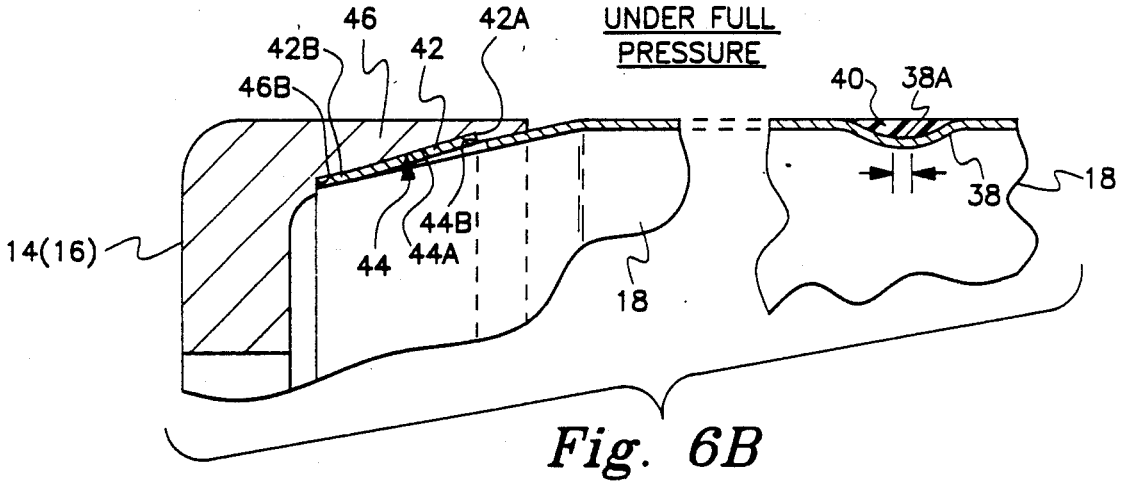
Figure 6C:
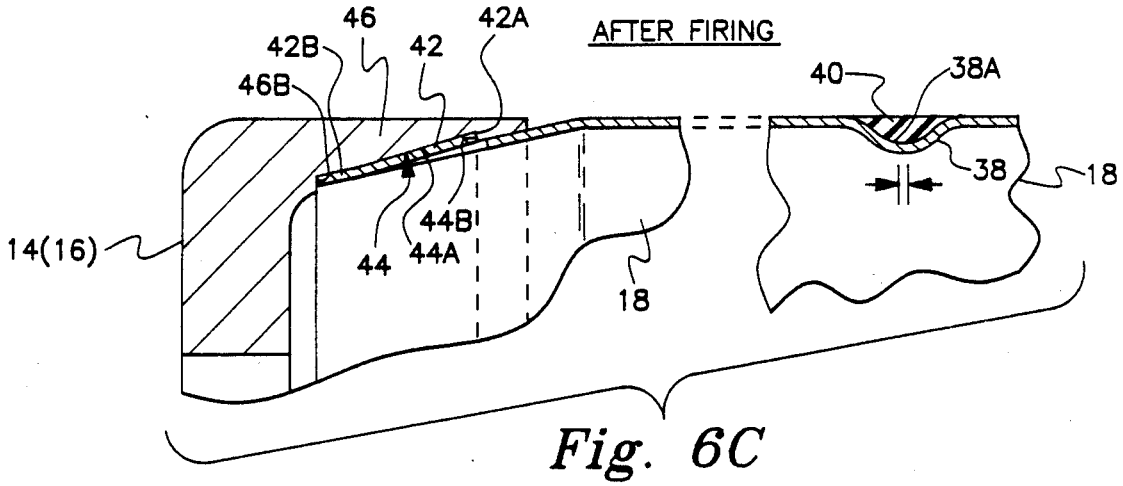

In another embodiment shown in FIGS. 6A–6C, the annular recess 44 is defined on the interior of each respective end cap flange 46. The spring fingers 42 deflect outside of the skin tube 18. Each respective skin tube end is reduced in diameter to fit within the tapered interior of the end cap flange 46 to where it abuts the outboard shoulder 46B formed thereon. The spring fingers 42 are seated in locking relation in the slanted recess 44 with their free ends 42A abutting the inboard end 44B of the recess 44. Preferably, as before, the spring fingers 42 at each opposite skin tube end are used in combination with the compressible material-filled annular bead 38 to ensure dimensional recovery of the case, the spring fingers 42 functioning to lock the end caps 14, 16 to the skin tube 18.

Assembly of either embodiment of the features just described is accomplished by snapping the end caps 14, 16 onto the ends of the skin tube 18 when all internal components have been installed. However, fabrication of the latter embodiment is somewhat more complicated than of the former embodiment because of the reduced diameter ends of the skin tube 18. Also, the propellant charge 22 must be some shape other than a simple hollow cylinder. In both embodiments, sealants must be applied to the mating surfaces.

Turning now to FIGS. 7 and 8A–8C, there is shown still other features of the present invention that combine attachment means for locking the end caps 14, 16 onto the opposite ends of the skin tube 18 of the round case 12 with spring means for permitting elongation of the skin tube 18 in response to increased internal pressure while causing retraction of the tube 18 upon relief of the pressure. The features relate to a pair of groups of spring fingers 42L and 42S, the fingers 42L in one group being of greater length than the fingers 42S in the other group. The long and short fingers 42L, 42S in both groups are pierced out from the case skin tube 18 adjacent each of the opposite ends thereof. Each long and short spring finger 42L, 42S extends in the axial direction of the case 12 and includes a free end 42A unattached to the skin tube 18 and a base 42B where it is attached to the skin tube 42L alternate with the short spring fingers 42S. The long beam portions 48L are aligned with one another circumferentially about the tube end and located contiguous with the tube edge portion at each respective tube end. The short beam portions 48S are aligned with one another circumferentially about the tube end and located inwardly from and generally in tandem relation with the long beam portions 48S. In other words, the long beam portions 48L are located outboard of the inboard short beam portions 48S at the respective tube ends.

Figure 8A:
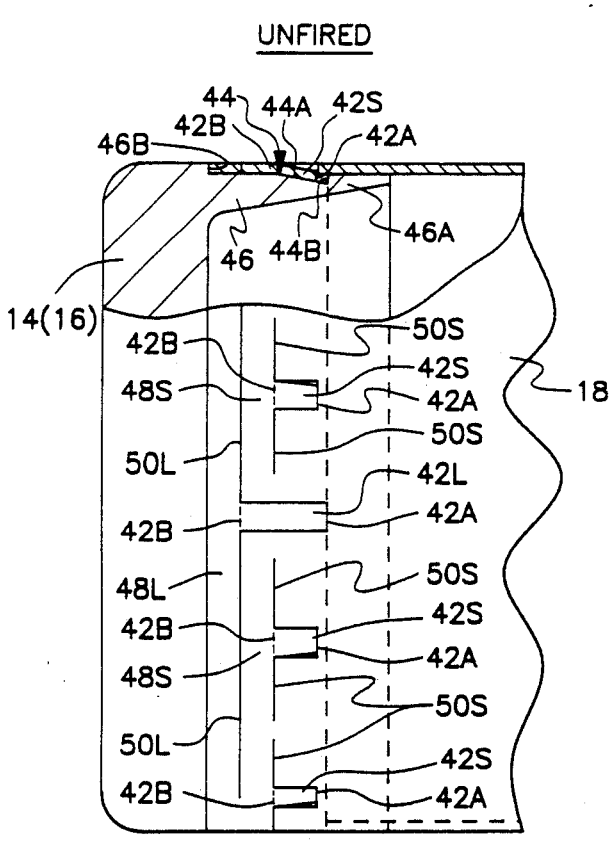
FIGS. 8A–8C are sequential fragmentary views of the ammunition round of FIG. 7, showing the features of the present invention illustrated in FIG. 7 in conditions where the ammunition is unfired, is under full pressure after firing, and is relieved of pressure after firing.
Figure 8B:
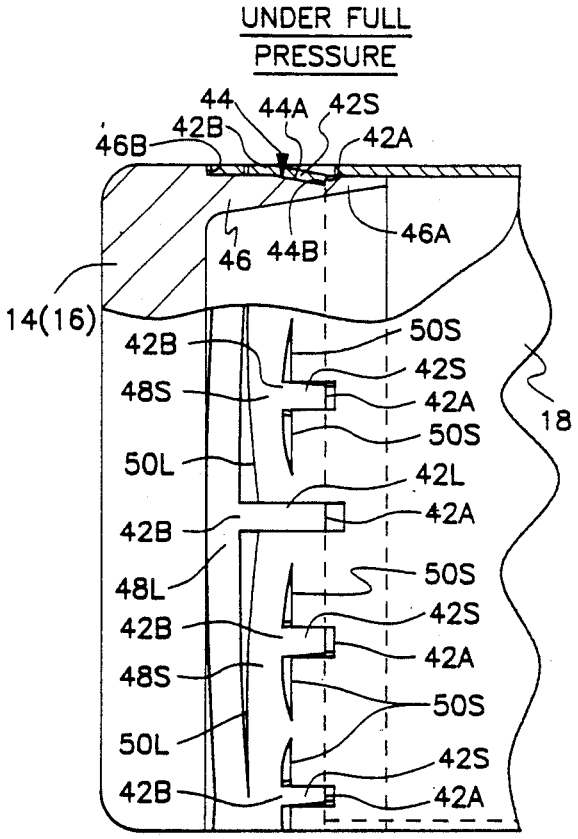

The long fingers 42L connected with the long outboard beam portions 48L are designed to rest in the recess 44 with their free ends 42A in contact with an inboard end 44B of the recess, whereas the free ends 42A of the short fingers 42S are spaced therefrom, as depicted in FIG. 8A. Upon elongation of the skin tube 18, the long outboard beam portions 48L will deflect first and then the short inboard beam portions 48S will deflect once the free ends 42A of the short fingers 48S contact the recess inboard end 44B, as depicted in FIG. 8B. Thus, the beam portions 48L, 48S will deform and yield as they are stressed to accommodate the axial movement of the end caps 14, 16 as the case 12 elongates to take up the static clearance of the case in the gun chamber plus the elastic deformation of the chamber.

Figure 8C:
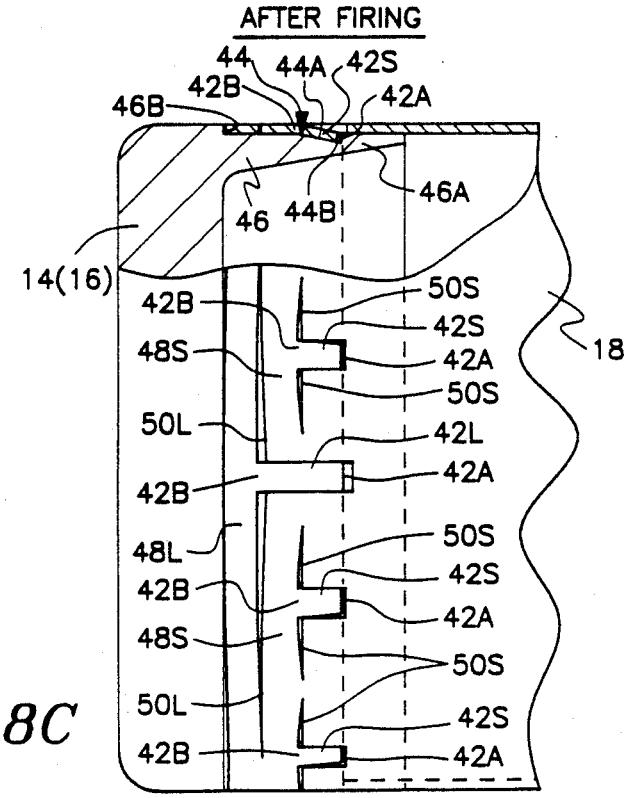

On the other hand, relaxation of the stress in the beam portions 48L, 48S will retract the end caps 14, 16 to something less than the original length of the gun chamber, as depicted in FIG. 8C. Radial clearance of the case is attained the same way as described above with respect to the features of FIGS. 3 and 4.

Overall advantages of the various features of the present invention as described above include a minimum number of joints to seal, no leakage of hot gas from the round onto the gun chamber walls, and extremely simple assembly resulting in an extremely sturdy unit. A significant advantage of the various features is that all of the internal components can be assembled as a unit and slid into the tube 18 and the end caps 14, 16 snapped into the ends of the tube 18 to complete the assembly. Suitable sealants must be applied to mating surfaces at assembly to provide for environmental sealing. Openings may be sealed with pressure sensitive tape.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In a cased telescoped ammunition round, the combination comprising:

(a) an elongated propellant charge having an axial bore therethrough;

(b) an elongated tubular case composed of a skin tube having opposite ends terminating in edges and end caps on said opposite ends of the tube, said case defining a chamber that contains said propellant charge;

(c) tubular means disposed in said case extending at least partially through said axial bore of said propellant charge at an aft portion thereof and attached at least at its aft end to said aft end of said case;

(d) a projectile housed within a forward portion of said axial bore of said propellant charge;

(e) a primer positioned within an aft portion of said tubular means and being actuatable for igniting said propellant charge to cause firing of said projectile forwardly from said case;

(f) resiliently-yieldable spring means on said tubular case for accommodating stretching and causing contraction thereof respectively upon and after the firing of said projectile, said spring means including an annular bead formed circumferentially about said case skin tube and projecting into said chamber thereof and a resiliently flexible and compressible material substantially filling said bead at an exterior side thereof, said bead and said material being elongatable to allow said case to stretch in response to high internal pressure created by ignition of said propellant charge and then to contract back toward its original dimensions in response to relief of the pressure; and (g) attachment means for locking said end caps onto said opposite ends of said skin tube of said case, said attachment means including (i) a plurality of inclined spring fingers formed from said skin tube adjacent each of said opposite ends thereof, said spring fingers at each skin tube end having inner free ends and being bent to project in an inclined fashion away from said skin tube and toward the opposite tube end, and (ii) an annular recess defined in each of said end caps, said recess having an outboard shoulder and an inboard end spaced from said shoulder, said recess also slanting at a slight angle to said skin tube so as to complement the inclination of said spring fingers for seating one of said skin tube ends and said inclined spring fingers projecting therefrom in locking relation in said slanting recess with said edge of said one skin tube end abutting said outboard shoulder of said recess and said free ends of said inclined spring fingers on said one skin tube end abutting said inboard end of said recess.

2. The ammunition round of claim 1 wherein said bead is arcuate shaped in cross-section.

3. The ammunition round of claim 1 wherein said springs fingers are of generally equal length.

4. The ammunition round of claim 1 wherein each of said end caps includes an annular flange, said annular recess being defined on the exterior of said annular flange.

5. The ammunition round of claim 4 wherein each skin tube end is fitted over the exterior of the respective end cap flange and said spring fingers at said skin tube end are seated in locking relation in said recess.

6. The ammunition round of claim 1 wherein each of said end caps includes an annular flange, said annular recess being defined on the interior of said annular flange.

7. The ammunition round of claim 6 wherein each skin tube end is fitted within the interior of the respective end cap flange and said spring fingers at said skin tube end are seated in locking relation in said recess.

8. In a cased telescoped ammunition round, the combination comprising:

(a) an elongated propellant charge having an axial bore therethrough;

(b) an elongated tubular case composed of a skin tube having opposite ends terminating in edges and end caps on said opposite ends of the tube, said case defining a chamber that contains said propellant charge;

(c) tubular means disposed in said case extending at least partially through said axial bore of said propellant charge at an aft portion thereof and attached at least at its aft end to said aft end of said case;

(d) a projectile housed within a forward portion of said axial bore of said propellant charge;

(e) a primer positioned within an aft portion of said tubular means and being actuatable for igniting said propellant charge to cause firing of said projectile forwardly from said case; and (f) attachment means for locking said end caps onto said opposite ends of said skin tube of said case, said attachment means including (i) a plurality of inclined spring fingers formed from said skin tube adjacent each of said opposite ends thereof, said spring fingers at each skin tube end having inner free ends and being bent to project in an inclined fashion away from said skin tube and toward the opposite tube end, and (ii) an annular recess defined in each of said end caps, said recess having an outboard shoulder and an inboard end spaced from said shoulder, said recess also slanting at a slight angle to said skin tube so as to complement the inclination of said spring fingers for seating one of said skin tube ends and said inclined spring fingers projecting therefrom in locking relation in said slanting recess with said edge of said one skin tube end abutting said outboard shoulder of said recess and said free ends of said inclined spring fingers on said one skin tube end abutting said inboard end of said recess.

9. The ammunition round of claim 8 wherein said spring fingers are of generally equal length.

10. The ammunition round of claim 8 wherein each of said end caps includes an annular flange, said annular recess being defined on the exterior of said annular flange.

11. The ammunition round of claim 10 wherein each skin tube end is fitted over the exterior of the respective end cap flange and said spring fingers at said skin tube end are seated in locking relation in said recess.

12. The ammunition round of claim 8 wherein each of said end caps includes an annular flange, said annular recess being defined on the interior of said annular flange.

13. The ammunition round of claim 12 wherein each skin tube end is fitted within the interior of the respective end cap flange and said spring fingers at said skin tube end are seated in locking relation in said recess.

* * * * *